US010505318B2

(12) United States Patent
Zhao et al.

(10) Patent No.: US 10,505,318 B2
(45) Date of Patent: Dec. 10, 2019

(54) ELECTRICAL CONNECTOR HAVING SEPARATE FRONT AND REAR SHIELDING SHELLS

(71) Applicant: FOXCONN INTERCONNECT TECHNOLOGY LIMITED, Grand Cayman (KY)

(72) Inventors: Jun Zhao, HuaiAn (CN); Cai-Yun Zhang, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/910,022

(22) Filed: Mar. 2, 2018

(65) Prior Publication Data

US 2018/0254587 A1 Sep. 6, 2018

(30) Foreign Application Priority Data

Mar. 3, 2017 (CN) ..... 2017 2 0206186 U

(51) Int. Cl.

| | |
|---|---|
| ***H01R 13/648*** | (2006.01) |
| ***H01R 13/6581*** | (2011.01) |
| ***H01R 12/72*** | (2011.01) |
| ***H01R 13/516*** | (2006.01) |
| ***H01R 4/02*** | (2006.01) |
| ***H01R 13/6595*** | (2011.01) |
| *H01R 24/60* | (2011.01) |
| *H01R 13/504* | (2006.01) |
| *H01R 107/00* | (2006.01) |
| *H01R 24/50* | (2011.01) |

(52) U.S. Cl.

CPC ..... *H01R 13/6581* (2013.01); *H01R 4/029* (2013.01); *H01R 12/724* (2013.01); *H01R 13/516* (2013.01); *H01R 13/6595* (2013.01); *H01R 13/504* (2013.01); *H01R 24/50* (2013.01); *H01R 24/60* (2013.01); *H01R 2107/00* (2013.01)

(58) Field of Classification Search

CPC .. H01R 13/506; H01R 13/41; H01R 13/6585; H01R 13/6581; H01R 13/6591; H01R 24/60

USPC ..... 439/607.01, 660, 676

See application file for complete search history.

(56) References Cited

U.S. PATENT DOCUMENTS

| | | | | |
|---|---|---|---|---|
| 10,170,863 | B2 * | 1/2019 | Qiu | H01R 13/6581 |
| 2010/0210139 | A1 * | 8/2010 | Wei | H01R 13/502 439/607.01 |
| 2011/0159747 | A1 * | 6/2011 | Tung | H01R 13/506 439/660 |

(Continued)

FOREIGN PATENT DOCUMENTS

| | | |
|---|---|---|
| TW | M497866 | 3/2015 |

*Primary Examiner* — Hae Moon Hyeon

(74) *Attorney, Agent, or Firm* — Wei Te Chung; Ming Chieh Chang

(57) ABSTRACT

An electrical connector includes: a housing having a base and a tongue; an upper and lower rows of contacts arranged in the housing and exposed respectively to two opposite surfaces of the tongue; a front and rear shielding shells enclosing the housing; and an insulative outer cover enclosing the front shielding shell, wherein the insulative outer cover has a rear notch exposing upwardly a rear portion of the front shielding shell, and the rear shielding shell has an upper welding piece welded to the rear portion of the front shielding shell.

11 Claims, 9 Drawing Sheets

(56) References Cited

U.S. PATENT DOCUMENTS

| | | | | |
|---|---|---|---|---|
| 2017/0331235 | A1 | 11/2017 | Yokoyama et al. | |
| 2017/0373442 | A1* | 12/2017 | Qiu | H01R 13/6581 |
| 2018/0151988 | A1* | 5/2018 | Zhao | H01R 13/6595 |
| 2018/0175559 | A1* | 6/2018 | Zhao | H01R 13/6591 |
| 2018/0366862 | A1* | 12/2018 | Zhao | H01R 13/6586 |

* cited by examiner

ELECTRICAL CONNECTOR HAVING SEPARATE FRONT AND REAR SHIELDING SHELLS

BACKGROUND OF THE INVENTION

1. Field of the Invention

The present invention relates to an electrical connector having a front and rear shielding shells enclosing the housing and an insulative outer cover enclosing the front shielding shell, wherein the rear shielding shell is welded to a rear portion of the front shielding shell.

2. Description of Related Arts

Taiwan Patent No. 497866 discloses an electrical connector including a contact module, a shielding shell enclosing the contact module, and a rear shielding plate removably mounted to the shielding shell.

U.S. Patent Application Publication No. 2017/0331235 discloses an electrical connector including a contact module, a shielding shell enclosing the contact module, and a rear shielding plate having a pair of press-fitting pieces fixed to an insulative housing of the contact module and a pair of welding pieces welded to the shielding shell.

SUMMARY OF THE INVENTION

An electrical connector comprises: a housing having a base and a tongue; an upper and lower rows of contacts arranged in the housing and exposed respectively to two opposite surfaces of the tongue; a front and rear shielding shells enclosing the housing; and an insulative outer cover enclosing the front shielding shell, wherein the insulative outer cover has a rear notch exposing upwardly a rear portion of the front shielding shell, and the rear shielding shell has an upper welding piece welded to the rear portion of the front shielding shell.

DETAILED DESCRIPTION OF THE PREFERRED EMBODIMENTS

Figure 1:
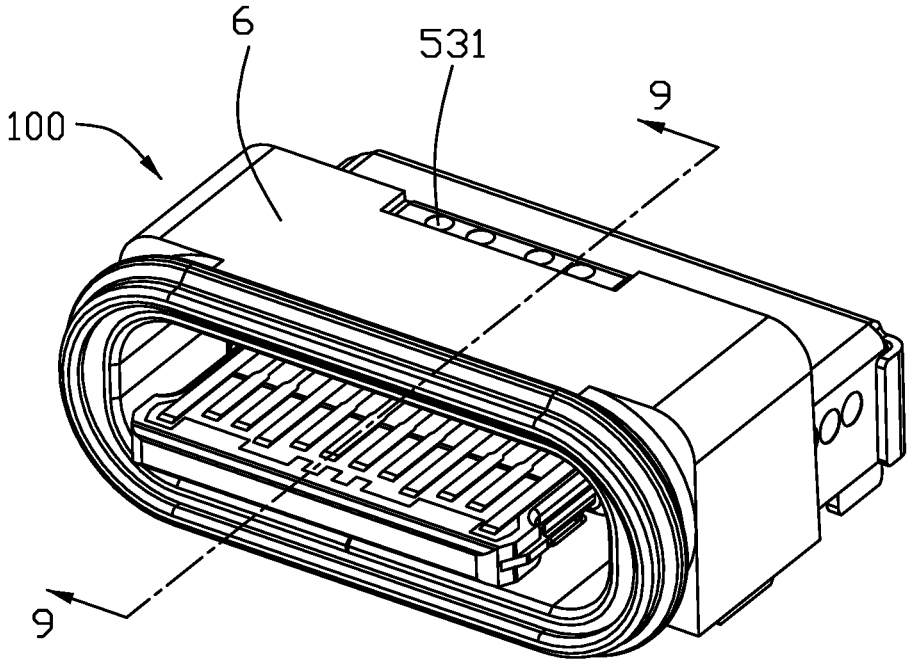
FIG. 1 is a front perspective view of an electrical connector in accordance with the present invention.

Referring to FIGS. 1-8, an electrical connector 100 comprises a housing 1, a plurality of contacts 2 arranged in the housing 1, metallic front and rear shielding shells 4 and 5 enclosing the housing 1, and an insulative outer cover 6 enclosing the front shielding shell 4. The electrical connector 100 may further include a rear sealing element 7 and a front sealing element 8.

Referring specifically to FIGS. 4-5 and 7-8, the housing 1 includes an upper insulator 11, a lower insulator 12, and an over-molding insulator 13. The upper insulator 11 includes a base 111 and a tongue 112. The base 111 has a stand 113, two holes 114, two blocks 115, and two steps 116 on the two blocks 115. The tongue 112 has a thickened portion 117 and a beam 118 across the thickened portion 117. Protrusions 119 are provided on the thickened portion 117 and the beam 118. The lower insulator 12 includes a base 121 and a tongue 122. The base 121 has two protrusions 123 and two latches 124. The tongue 122 has a thickened portion 125 and a beam 126 across the thickened portion 125. Protrusions 127 are provided on the thickened portion 125 and the beam 126. The insulator 13 has two side notches 131. The bases 111 and 121 constitute an overall base of the insulative housing 1; the tongues 112 and 122 and the insulator 13 constitute an overall tongue of the insulative housing 1.

Figure 2:
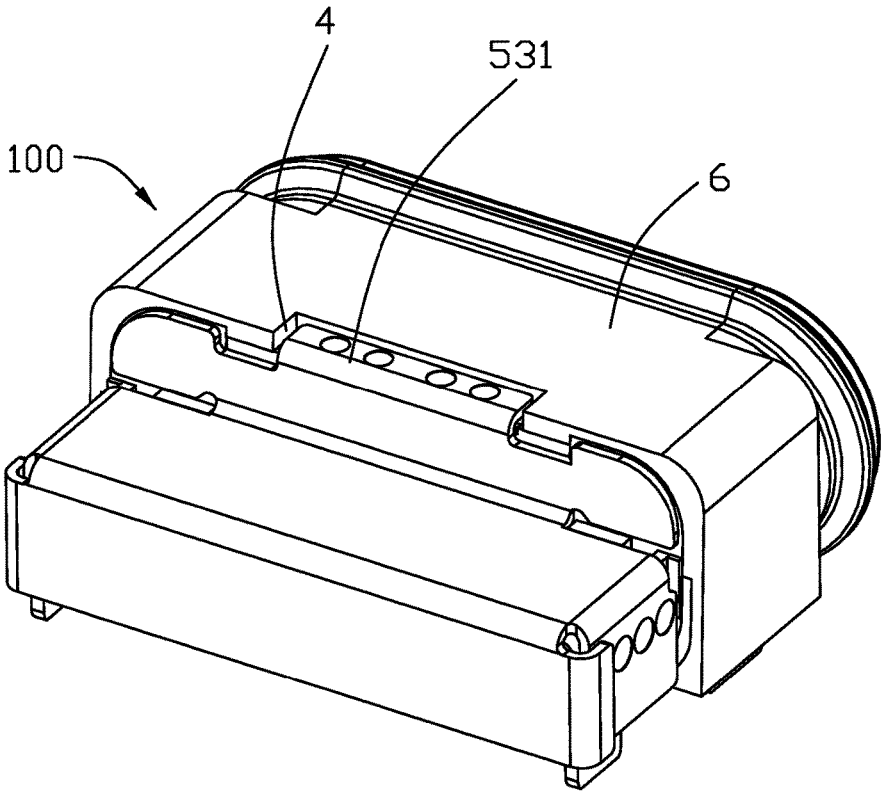
FIG. 2 is a rear perspective view of the electrical connector.
Figure 3:
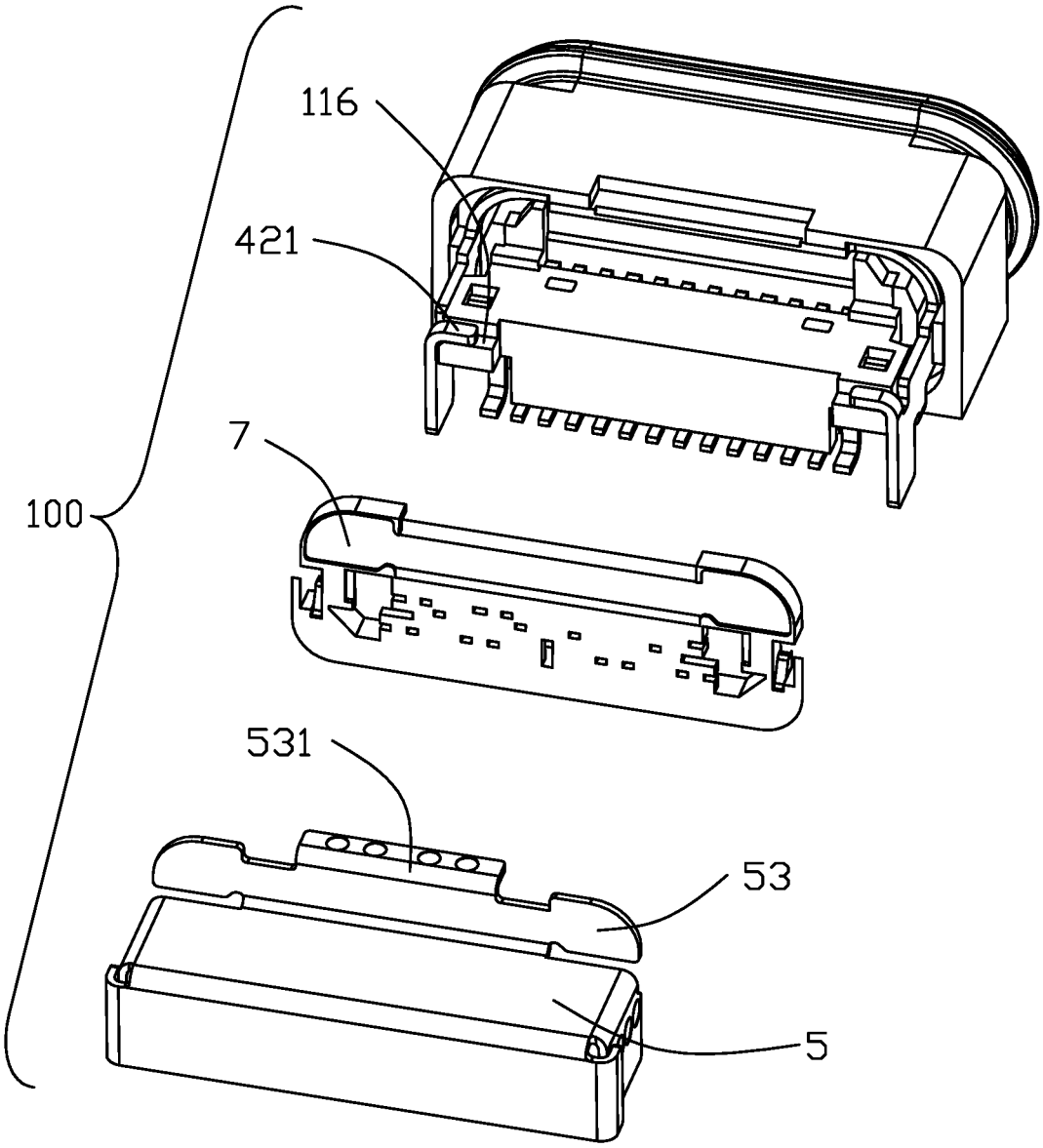
FIG. 3 is an exploded view of FIG. 2.
Figure 4:
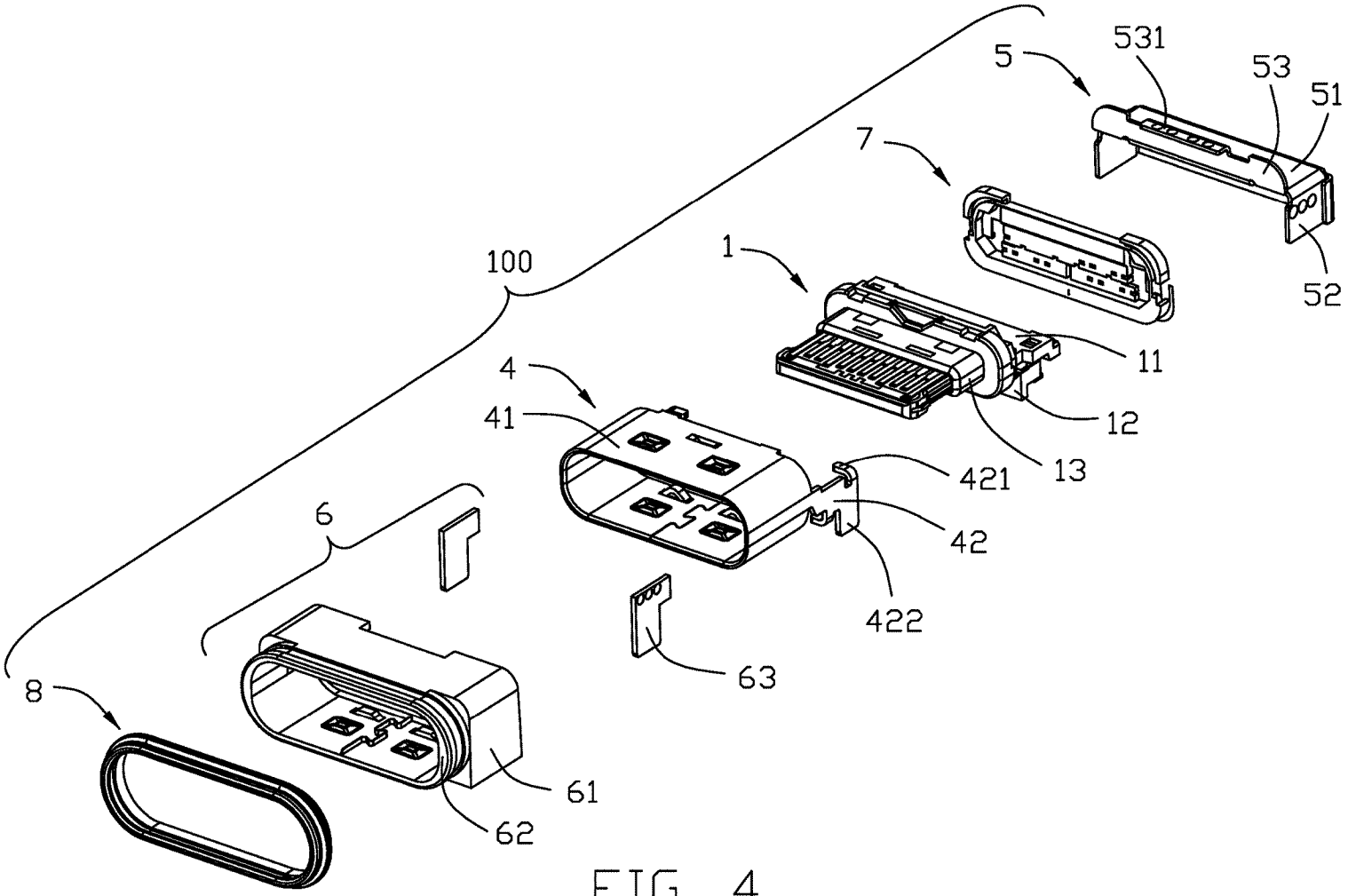
FIG. 4 is an exploded view of FIG. 1.
Figure 5:
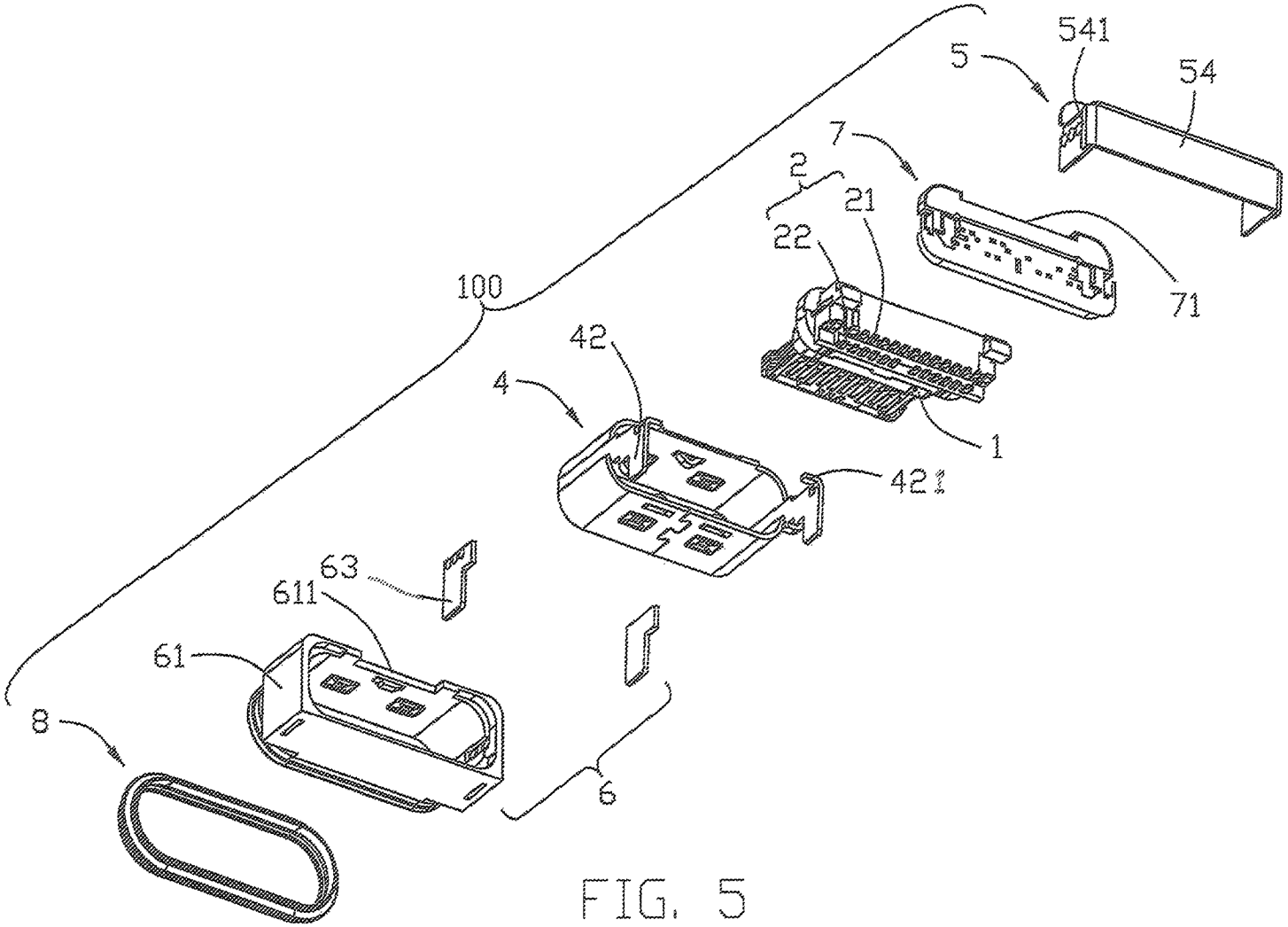
FIG. 5 is a view similar to FIG. 4 but from a different perspective.
Figure 6:
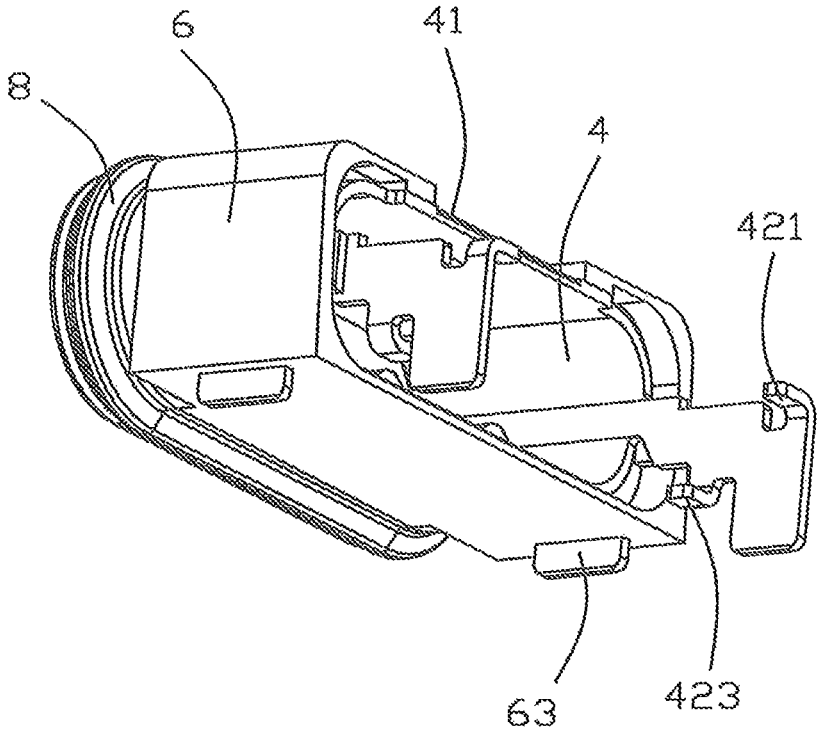
FIG. 6 is a rear perspective view of a front shielding shell and an insulative outer cover of the electrical connector.
Figure 7:
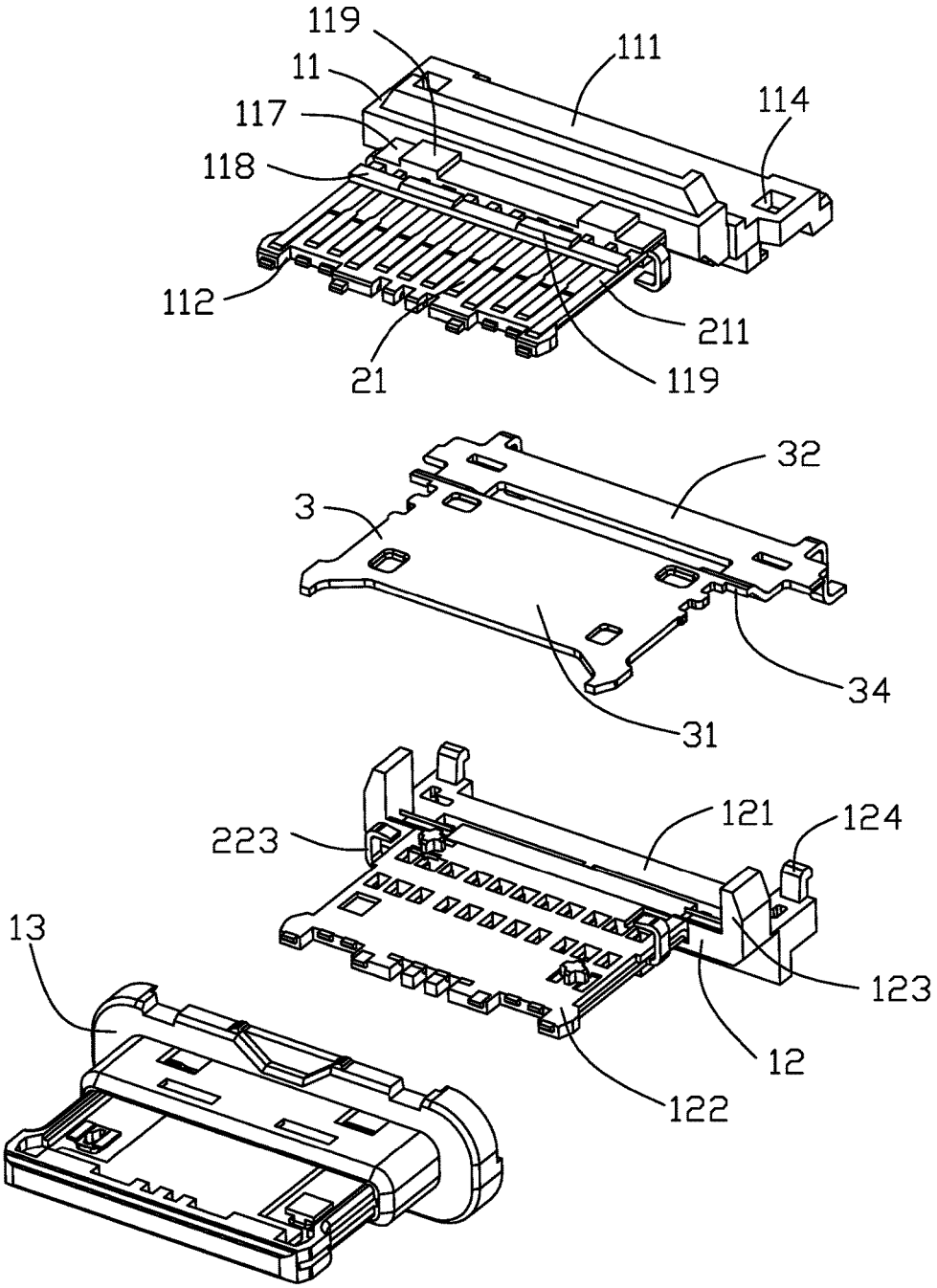
FIG. 7 is an exploded view of a housing and a plurality of contacts of the electrical connector.
Figure 8:
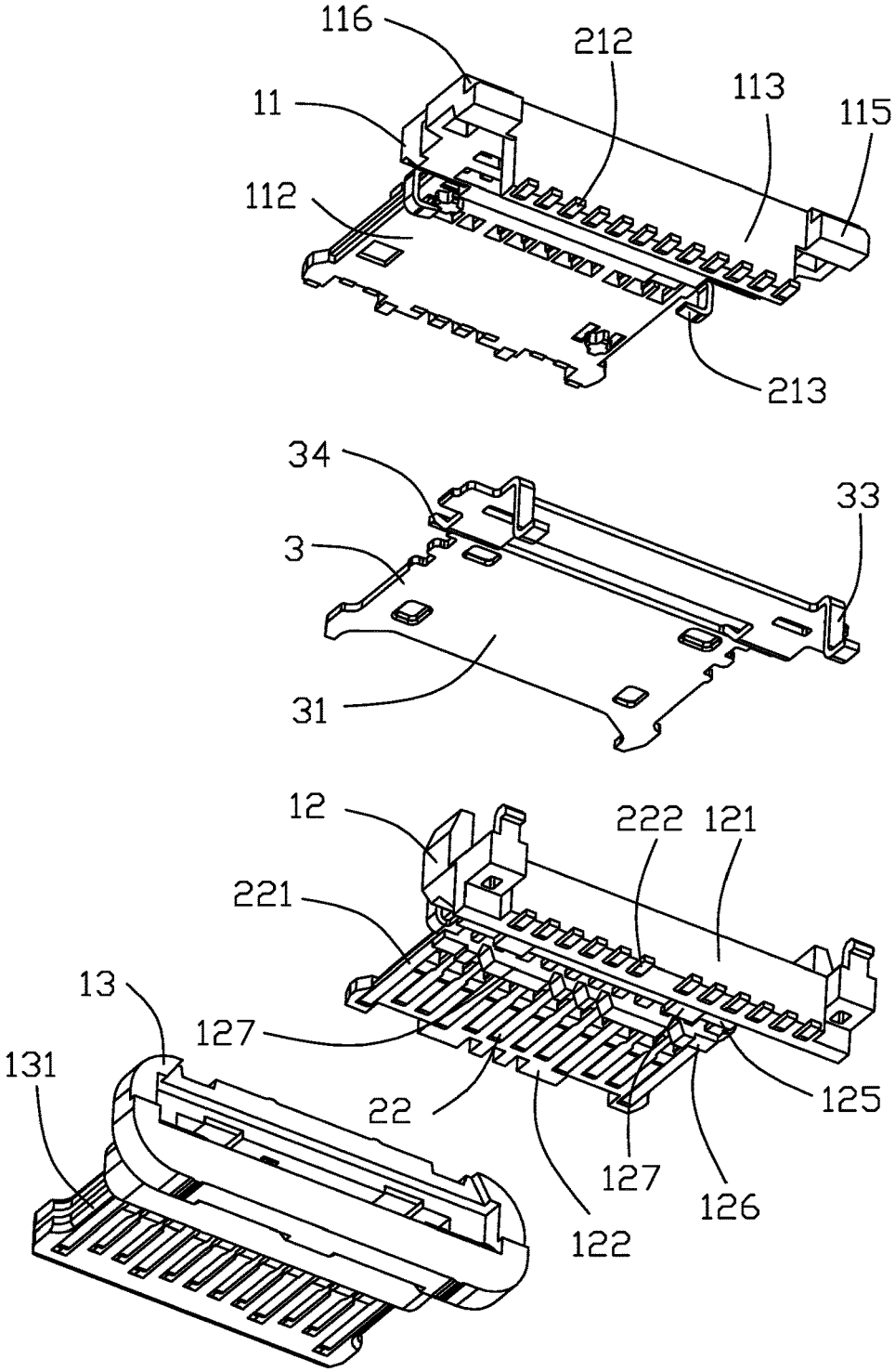
FIG. 8 is a view similar to FIG. 7 but from a different perspective.
Figure 9:
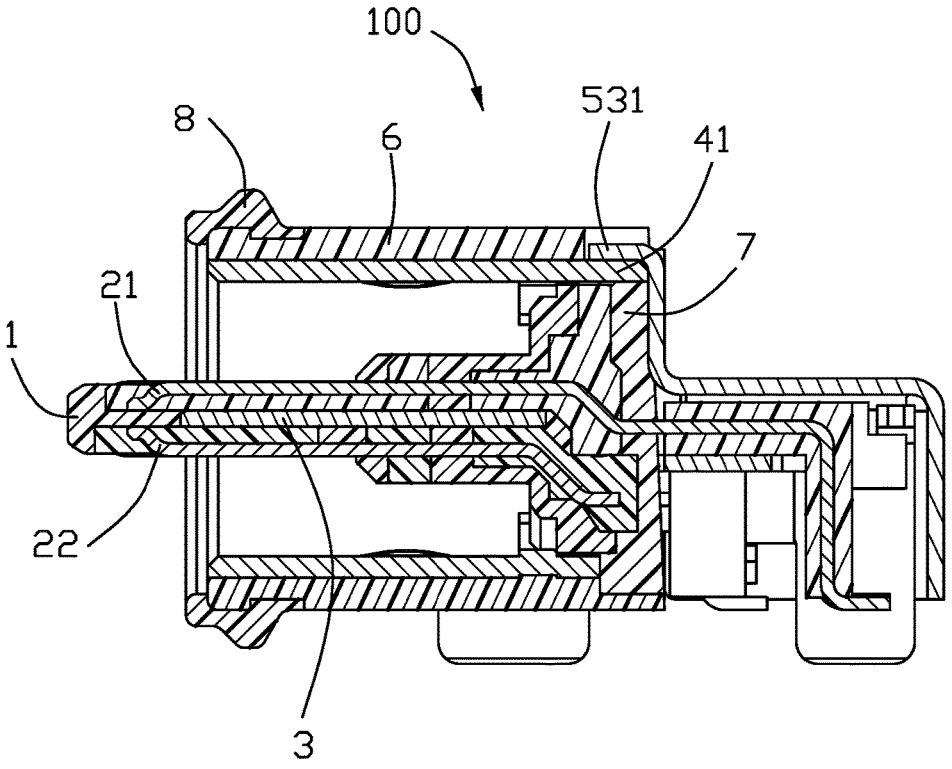
FIG. 9 is a cross-sectional view of the electrical connector in FIG. 1 taken along line A-A thereof.

Referring specifically to FIGS. 1-3, the plurality of contacts 2 include an upper row of contacts 21 secured to the upper insulator 11 and a lower row of contacts 22 secured to the lower insulator 12.

Referring again to FIGS. 1-8, the upper contact 21 includes a contacting portion 211 and a soldering portion 212 and the lower contact 22 includes a contacting portion 221 and a soldering portion 222. The upper contacting portions 211 and the lower contacting portions 221 are reversely-symmetrically arranged, as is well known in this art. The two outermost upper contacts have respective coupling portions 213 for engaging the thickened portion 125; the two outermost lower contacts have respective coupling portions 223 for engaging the beam 118 to obtain a stable structure of the upper and lower insulators 11 and 12 and a middle shielding plate 3 if present.

Referring again specifically to FIGS. 4-5 and 7-8, the shielding plate 3 is clamped between the upper insulator 11 and the lower insulator 12. The shielding plate 3 has a main portion 31, a rear extension 32, and a pair of legs 33. The rear extension 32 has a pair of spring tangs 34 clamped between the two bases 111 and 121.

Referring specifically to FIGS. 1-4, the front shielding shell 4 includes a tubular part 41 and a pair of mounting plates 42 with legs 422 and engaging fingers 421 and 423. The upper finger 421 abuts the steps 116 and the lower finger 423 abuts the base 121 of the lower insulator 12.

Referring specifically to FIGS. 1-5, the rear shielding shell 5 is disposed at a rear of the housing 1 and includes a top wall 51, a pair of side walls 52, a front wall 53 extending upwardly from the top wall 51, and a rear wall 54 extending downwardly from the top wall 51. The front wall 53 has an upper welding piece 531 for being welded to a rear portion of the front shielding shell 4. The rear wall 54 has an extension 541 overlapping the side wall 52. The side walls 52 are welded to the corresponding mounting plates 42, respectively.

Referring specifically to FIGS. 1-6, the insulative outer cover 6 includes a main body 61 and a front part 62 for accommodating the front sealing element 8. A pair of metallic positioning pieces 63 may be integrated into the insulative outer cover 6. The main body 61 has a rear notch 611 exposing upwardly the rear portion of the front shielding shell 4 that is to be welded to the upper welding piece 531 of the front wall 53 of the rear shielding shell 5. The positioning piece 63 may on one hand be welded to the front shielding shell 4 and on the other hand extend out of the insulative outer cover 6.

Referring again specifically to FIGS. 1-5, the rear sealing member 7 is disposed inside a rear end of the insulative outer cover 6. The rear sealing member 7 seals gaps between the housing 1 and the front shielding shell 4 wherein the rear sealing member 7 forms a recess 71 to receive corresponding portions of both the front shielding shell 4 and the rear shielding shell 5 welded together.

Using the rear shielding shell 5 discrete from the front shielding shell 4 is the main feature of the invention. As indicated before, leaving the rear notch 611 in the main body 61 for facilitating welding the rear shielding shell 5 and the front shielding shell 4 together is a further detailed feature. Furthermore, the engaging finger 421 and the engaging finger 423 grasp two opposite surfaces of the housing 1 to not only secure the housing 1 and the front shielding shell 4 together but also prevent the backward movement of the housing 1 relative to the front shielding shell 4 during mating, wherein the rear shielding shell 5 not only secures to the front shielding shell 4 but also protectively covers the engaging finger 421 in both downward direction and the forward direction so as not to be outwardly deflected away from its securing position. Notably, the engaging finger 421 located at a rear end of the housing 1 may be easily bent for assembling the front shielding shell 4 to the housing 1.

What is claimed is:

1. An electrical connector comprising:

a housing having a base and a tongue;

an upper and lower rows of contacts arranged in the housing and exposed respectively to two opposite surfaces of the tongue;

a front and rear shielding shells enclosing the housing; and an insulative outer cover enclosing the front shielding shell; wherein the insulative outer cover has a rear notch exposing upwardly a rear portion of the front shielding shell, and the rear shielding shell has an upper welding piece welded to the rear portion of the front shielding shell.

2. The electrical connector as claimed in claim 1, wherein the front shielding shell has a pair of side mounting plates extending rearward beyond the insulative outer cover and welded to the rear shielding shell.

3. The electrical connector as claimed in claim 1, further comprising a rear sealing member disposed inside a rear end of the insulative outer cover.

4. The electrical connector as claimed in claim 1, further including a pair of positioning pieces mainly embedded within the insulative outer cover and welded to the front shielding shell and further downwardly extending out of the insulative outer cover.

5. An electrical connector comprising:

an insulative housing forming a base and a tongue forwardly extending from the base;

two rows of the contacts disposed in the housing and exposed upon two opposite surfaces of the tongue;

a metallic front shielding shell attached to the housing and including an upper engaging finger and a lower engaging finger respectively abutting against two opposite upper and lower surfaces of the housing for securing the front shielding shell to the housing; and a rear shielding shell secured to the front shielding shell and protectively covering the upper engaging finger.

6. The electrical connector as claimed in claim 5, wherein said front shielding shell includes a tubular part and a pair of mounting plates rearwardly extending therefrom, and the rear shielding shell is welded to at least one of the tubular part and the pair of mounting plates.

7. The electrical connector as claimed in claim 5, further including a rear sealing member sealing gaps between the front shielding shell and the housing, wherein said rear sealing includes a recess wherein the front shielding shell and the rear shielding shell welded together.

8. The electrical connector as claimed in claim 5, wherein said upper finger is located at a rear end of the housing and confronts the rear shielding shell both upwardly and rearwardly.

9. An electrical connector comprising:

an insulative housing forming a base and a tongue forwardly extending from the base;

two rows of the contacts disposed in the housing and exposed upon two opposite surfaces of the tongue;

a metallic front shielding shell attached to the housing;

a metallic rear shielding shell welded to the front shielding shell to cover a rear side of the housing; and a rear sealing member sealing gaps between the housing and the front shielding shell; wherein rear sealing member forms a recess in which both said front shielding shell and said rear shielding shell are welded together.

10. The electrical connector as claimed in claim 9, further including an insulative outer cover enclosing the front shielding shell, wherein said outer cover forms, corresponding to said recess, a notch in which both said front shielding shell and said rear shielding shell are welded together.

11. The electrical connector as claimed in claim 9, wherein said front shielding shell further includes a pair of mounting plates welded to the rear shielding shell.

* * * * *